US008453845B2

(12) United States Patent
Kising

(10) Patent No.: US 8,453,845 B2
(45) Date of Patent: Jun. 4, 2013

(54) SCREEN SYSTEM WITH TUBE-SHAPED SCREEN AND METHOD FOR OPERATING A SCREEN SYSTEM WITH TUBE-SHAPED SCREEN

(75) Inventor: Juergen Kising, Kreuzlingen (CH)

(73) Assignee: Artech Systems AG, Romanshorn (CH)

( * ) Notice: Subject to any disclaimer, the term of this patent is extended or adjusted under 35 U.S.C. 154(b) by 285 days.

(21) Appl. No.: 12/746,412

(22) PCT Filed: Nov. 25, 2008

(86) PCT No.: PCT/EP2008/009972

§ 371 (c)(1),
(2), (4) Date: Jun. 30, 2010

(87) PCT Pub. No.: WO2009/071221

PCT Pub. Date: Jun. 11, 2009

(65) Prior Publication Data

US 2010/0258482 A1 Oct. 14, 2010

(30) Foreign Application Priority Data

Dec. 5, 2007 (EP) ..... 07023546

(51) Int. Cl.
*B07B 1/44* (2006.01)

(52) U.S. Cl.
USPC ..... 209/365.4; 209/270; 209/287; 209/325

(58) Field of Classification Search
USPC ..... 209/235, 254, 287, 362
See application file for complete search history.

(56) References Cited

U.S. PATENT DOCUMENTS

| | | | | |
|---|---|---|---|---|
| 3,352,238 | A * | 11/1967 | Spragg et al. | 102/370 |
| 5,595,306 | A * | 1/1997 | Hukki et al. | 209/325 |
| 5,653,346 | A * | 8/1997 | Frei et al. | 209/254 |
| 6,845,868 | B1 * | 1/2005 | Krush et al. | 209/365.4 |
| 7,497,338 | B2 * | 3/2009 | Garrett et al. | 209/381 |
| 7,763,410 | B2 * | 7/2010 | Yamaguchi et al. | 430/137.2 |
| 2002/0096460 | A1 * | 7/2002 | Ruescher et al. | 210/154 |
| 2008/0217214 | A1 * | 9/2008 | Aikawa | 209/270 |
| 2010/0117564 | A1 * | 5/2010 | Kising | 318/114 |

FOREIGN PATENT DOCUMENTS

| | | |
|---|---|---|
| DE | 30 19 113 | 11/1980 |
| DE | 44 18 175 A1 | 12/1994 |
| DE | 198 11 266 C1 | 8/1999 |

OTHER PUBLICATIONS

PCT/EP2008/009972 International Search Report, 4 pages.

* cited by examiner

*Primary Examiner* — Terrell Matthews
(74) *Attorney, Agent, or Firm* — Andrew F. Young, Esq.; Lackenbach Siegel, LLP

(57) ABSTRACT

The invention is a method and system for screening materials with a tube-shaped screen. The tube that has at least one section with a plurality of screen openings, which are placed in the wall of the tube, and that form a screen frame which defines at least the length and the cross section of the tube, and a screen mesh, that is tensioned on the screen frame, to form at least a part of the wall of the tube-shaped screen. The system further includes at least one ultrasonic converter and at least one feed-line sound conductor placed between the ultrasonic converter and the tube, with the tube being configured, to be subjected to ultrasonic excitation so that the amplitude of the ultrasonic excitation transferred to the tube has a component in a direction perpendicular to, and a component in a direction parallel to, the central axis of the screen.

20 Claims, 3 Drawing Sheets

SCREEN SYSTEM WITH TUBE-SHAPED SCREEN AND METHOD FOR OPERATING A SCREEN SYSTEM WITH TUBE-SHAPED SCREEN

CROSS REFERENCE TO RELATED APPLICATIONS

This application is a national phase entry of PCT/EP2008/009972, published as WO 2009/071221 filed Nov. 25, 2008, the entire contents of which are herein incorporated fully by reference; which in turn claims priority from European Patent Application Serial No. 07 023546.0, filed Dec. 5, 2007.

FIGURE FOR PUBLICATION

FIG. 3.

BACKGROUND OF THE INVENTION

1. Field of the Invention

The present invention relates to a screening system for screening materials in order to prevent agglomeration, or to simply cause a break-up of the materials. More specifically, the present invention relates to a screen system for a centrifugal screening machine with a tube-shaped screen, and a procedure for operating a tube-shaped screen that causes increased amounts of screened material to pass through based on ultrasonic excitation of the screening system.

2. Description of the Related Art

In industry, there is a multiplicity of applications in which it is desirable to classify a material by size and/or keep particles from agglomerating, or breaking them up if they already have done so.

For this purpose, generally known screening machines are used which apply screening systems that differ particularly in the configuration and direction of the screen used. With the current vibration-type and tumbling-type screening machines, screens are used that have an essentially planar screen mesh kept in tension in a frame, the tension which in essence is directed perpendicular to the desired direction in which the material flows. The screened material that does not meet the classification condition pre-set by the openings of the screen mesh, stays back on the screen; only screened material that meets the classification condition can leave the screen.

While these classes of screening machines, based on the screening arrangement used by them, are able to be applied for batch-fed screened material, they are poorly suited for use when screened material is fed continuously. Particularly in these latter instances, centrifugal screening machines, also known under the designation of vortex flow screening machines, are used. One such screening machine, for example, is known from DE 30 19 113 C2.

With the type of screening machine designated in this patent application as a "centrifugal screening machine," the screen system used has a tube-shaped screen, into the interior of which the screened material is fed. The tube-shaped screen can consist of a tube with screen openings that are directly placed in the wall of the tube; however, it can also be formed by a screen mesh that is placed in tension on a screen frame that defines at least the length and the cross section of a tube, so that the screen mesh forms a part of the surface of the tube-shaped screen and especially is configured not just in a plane. In addition, embodiment forms are also conceivable in which both a tube with screen openings, and an additional screen mesh that surrounds this tube, are provided.

A tube in accordance with this specification is an elongated hollow body with an opening running through it lengthwise and having a cylindrical cross section as a rule; accordingly, the adjective "tube-shaped" describes an object that has the form of a tube according to the definition used previously.

The tube-shaped screen acts achieves its screening action in that the material to be screened passes through the screen openings and/or the screen mesh that form at least a part of the tube wall. To ensure that considerable material passes through the screen openings and/or the screen mesh, there are two particularly expanded attachments. This is an option that is especially used with relatively small concentrations of the material to be screened, and consists in providing within the tube-shaped screen a fluid flow that transports the material, which is provided with one such flow rate, so that the material is transported through the screen openings and/or the screen mesh.

An alternative option, especially with high concentrations of material to be screened, consists in providing a so-called "impactor system" in the interior of the tube-shaped screen, i.e., a rotary gear manufactured as a rule out of metal, that is guided along the walls of the tube-shaped screen and pushes the screened material through the screen openings and/or the screen mesh and, if necessary, radial openings of the frame structure.

Generally with screen systems the problem is to prevent even temporary plugging of the screen openings and/or the screen mesh, as can happen for example by agglomeration of particles of screened material, and to ensure that screened material passes as efficiently as possible through the screen mesh. With screen systems that are used in centrifugal screening machines, this problem is exacerbated mostly because the screened material gets coated on the screen openings and/or the screen mesh, by an impactor system, for example.

For screen systems with planar screens in which the screen mesh forms a plane placed in tension in a screen frame, it is known to use ultrasonic excitation to reduce the tendency of the screen mesh to become clogged. One such screen system is known, for example, from DE 4418175. However, it is impossible to simply transfer this approach to screen systems with tube-shaped screens. The throughput does not significantly increase to what is desired.

Based on this prior art, the problem is to produce a screen system for a centrifugal screening machine with a tube-shaped screen, and a procedure for operating a tube-shaped screen that causes increased amounts of screened material to attainably pass through.

Accordingly, there is a need for an improved method and system for increasing throughput of screened material

ASPECTS AND SUMMARY OF THE INVENTION

The basis for the invention is that ultrasonic excitation of a tube-shaped screen results in a significant increase in throughput of screened material, if the amplitude of the ultrasonic excitation has both a component in the radial direction and a component in the axial direction of the tube-shaped screen.

An aspect of the present invention is to provide a tube that at a minimum has a section with screen openings that are arrayed directly in the wall of the tube and/or a screen mesh that is tensioned on a screen frame that defines at least the length and the cross section of a tube, so that the screen mesh forms at least a part of the wall of the tube-shaped screen, as well as at least one ultrasonic converter and at least a second ultrasonic converter and feed-line sound conductors arrayed for the screen frame, with the tube or the screen frame configured to be able to be subjected by means of the ultrasonic converter and the feed-line sound conductor to an ultrasonic excitation, that the amplitude of the ultrasonic excitation transferred to the tube or to the screen frame has a component in a direction perpendicular to a central axis of the tube-shaped screen and a component in a direction parallel to the central axis of the tube-shaped screen. By providing such longitudinal and transverse components of the oscillation amplitude, on the one hand, it is ensured that the ultrasound will propagate over the entire tube-shaped screen; and, on the other hand, at every location it makes available a component of the oscillation amplitude that evokes an intensive, throughput-enhancing interaction between the screened material and the screen openings and/or the screen mesh.

In a preferred embodiment form, when ultrasound is excited, both components of the amplitude of ultrasonic excitation are transferred at a single contact point between the feed-line sound conductor and the tube or screen frame. This permits an especially cost-effective embodiment with only one ultrasonic converter and only one feed-line sound conductor.

This especially can be achieved if the one feed-line sound conductor has at least one curved section. In advantageous fashion, the curvature angle of the curved section is more than 0 degrees and a maximum of 90 degrees, with a curvature angle of 90 degrees being especially well suited for most applications.

Use of a feed-line sound conductor with a diameter of 12 mm has been shown to be particularly advantageous.

An especially robust and interference-resistant embodiment form of the screen system is obtained if fixed links are provided between the feed-line sound conductor and the surface of the tube or surface of the screen frame. This can especially be done by screwing or welding on.

Additionally, providing a fixed link between the feed-line sound conductor and ultrasonic converter has been shown to promote robustness and interference resistance in the screen system. Here, especially, the screw attachment is suitable to produce such a secure connection.

If one would like to obtain a screen system in which especially great oscillatory energy can be inputted into the screen mesh, this can be achieved by providing more than one ultrasonic converter and more than one feed-line sound conductor.

In addition, if more than one feed-line sound converter is present, and the tube or the screen frame can be ultrasonically excited via the feed-line sound conductor, a component in a direction perpendicular to a central axis of the tube-shaped screen, and a component in a direction parallel to the central axis of the tube-shaped screen can be produced by differentiating the direction of the amplitude of ultrasonic excitation that is transferred by differing feed-line sound conductors to the tube or the screen frame. This embodiment form of the invention has especially proven itself if it is necessary to deliberately adjust the size of both components of the amplitude of ultrasonic excitation.

Additionally it makes sense in operating such a screen system to place the ultrasonic converters present outside the flow of screened material, since on the one hand this can evoke material changes in the screened material, and on the other hand, they can become contaminated and damaged in the flow of screened material. This goal can be achieved if the screen system has a housing that prevents screened material from leaking into the environment and places all the ultrasonic converters present outside the housing.

The screen systems described here with a tube-shaped screen are particularly well-suited for use in centrifugal screen systems.

With the invention-specific procedure for operating a screen system with a tube-shaped screen that has a tube with screen openings that are placed directly in the wall of the tube and/or a screen frame that defines at least the length and the cross section of a tube, so that the screen mesh forms at least a part of the surface of the tube-shaped screen, the tube with the screen openings or the screen frame is excited by ultrasound with an amplitude that has a component in a direction perpendicular to a central axis of the pipe-shaped screen and a component in a direction parallel to the central axis of the pipe-shaped screen. The presence of these two amplitude components ensures that on the one hand, the ultrasonic excitation-evoked vibrations propagate over the entire tube-shaped screen, while at the same time, at every location on the screen, good prerequisites are ensured for increasing efficiency of the screening process.

The process can be carried out with especially small expense in materials if the amplitude that has one component in a direction perpendicular to a central axis of the tube-shaped screen and one component in a direction parallel to the central axis of the tube-shaped screen, is generated by exactly one feed-line sound conductor.

The two components of the vibration amplitude are especially well controlled in size distribution terms if the amplitude which has one component in a direction perpendicular to a central axis of the tube-shaped screen and one component in a direction parallel to the central axis of the tube-shaped screen is generated by more than one feed-line sound conductor.

It has been shown that the throughput can additionally be significantly increased by not operating at a fixed excitation frequency, but rather than the frequency of the ultrasonic excitation is varied. This occurs through appropriate use of a control device to drive the ultrasonic converter. The range in which the frequency is varied advantageously lies between 32 kHz and 38 kHz. Especially good results can be achieved if the frequency modulation occurs via sweeping, i.e. a continuous variation in frequency.

The above, and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
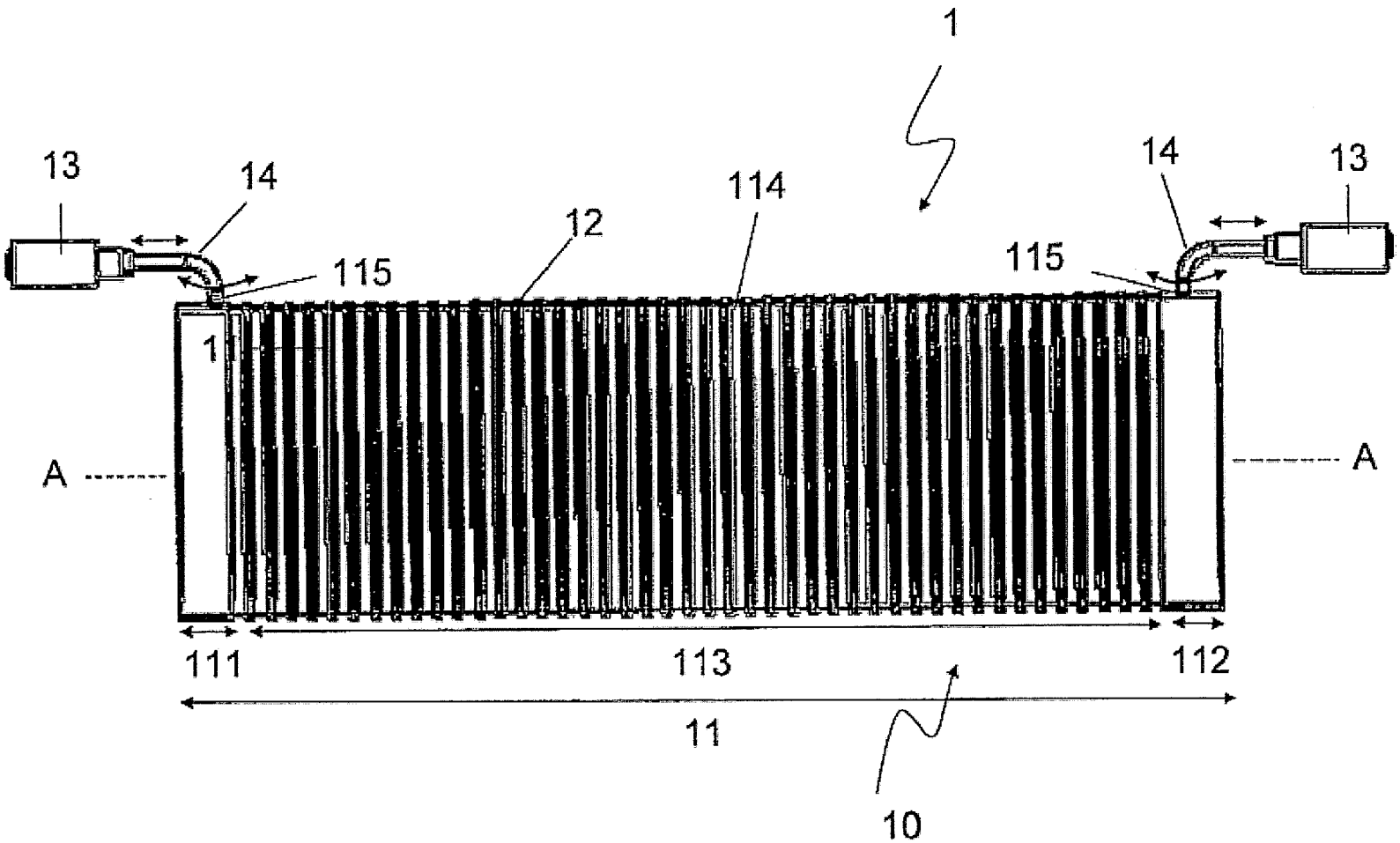
FIG. 1 is a depiction of a screen system with a tube-shaped screen according to a first embodiment of the present invention

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

FIG. 1 shows a screen system 1 with a tube-shaped screen 10, which, in the depicted embodiment form, has the form of a hollow cylinder.

The tube-shaped screen 10 consists of a tube 11 that has two annular end sections 111, 112, between which a cylindrical section 113 is placed. In cylindrical section 113 lies a multiplicity of sections 114 depicted in a bright color, in which the tube 11 has numerous small screen openings, which, due to their small size are not plotted for reasons of clarity. In addition, the tube 11 in the cylindrical section 113 has a multiplicity of reinforcement ribs 12 that are dark-colored, to distinguish them from the sections with screen openings.

In addition, screen system 1 has two ultrasonic converters 13 and two feed-line sound conductors 14. In this embodiment form, the use of two feed-line sound conductors 14 and two ultrasonic converters 13 especially serves to increase vibrational energy transmitted to tube 11. It has a central axis A-A.

The tube 11 is mechanically connected via the feed-line sound conductors 14 with the ultrasonic converters 13. The feed-line sound conductors 14 have a curved design. As indicated by the arrows in FIG. 1, through the ultrasonic converters 13, an ultrasonic oscillation with an oscillation amplitude that is directed parallel to central axis A-A, is fed into the feed-line sound conductors 14. The result of the curvature of feed-line sound conductors 14 is that the oscillation amplitude obtains an additional component perpendicular to central axis A-A. The exact division of the components is determined by the geometric configuration of the feed-line sound conductors 14, especially by their curvature.

At the contact points 115, the ultrasonic oscillation is transferred to tube 11. The vibration evoked thereby propagates over tube 11. Through the longitudinal component of the amplitude of the ultrasonic excitation, propagation of the ultrasound is promoted over the entire length of the tube-shaped screen, while the transversal component of the screening process especially increases the efficiency of the screening process at every given location of pipe 11.

Figure 2:
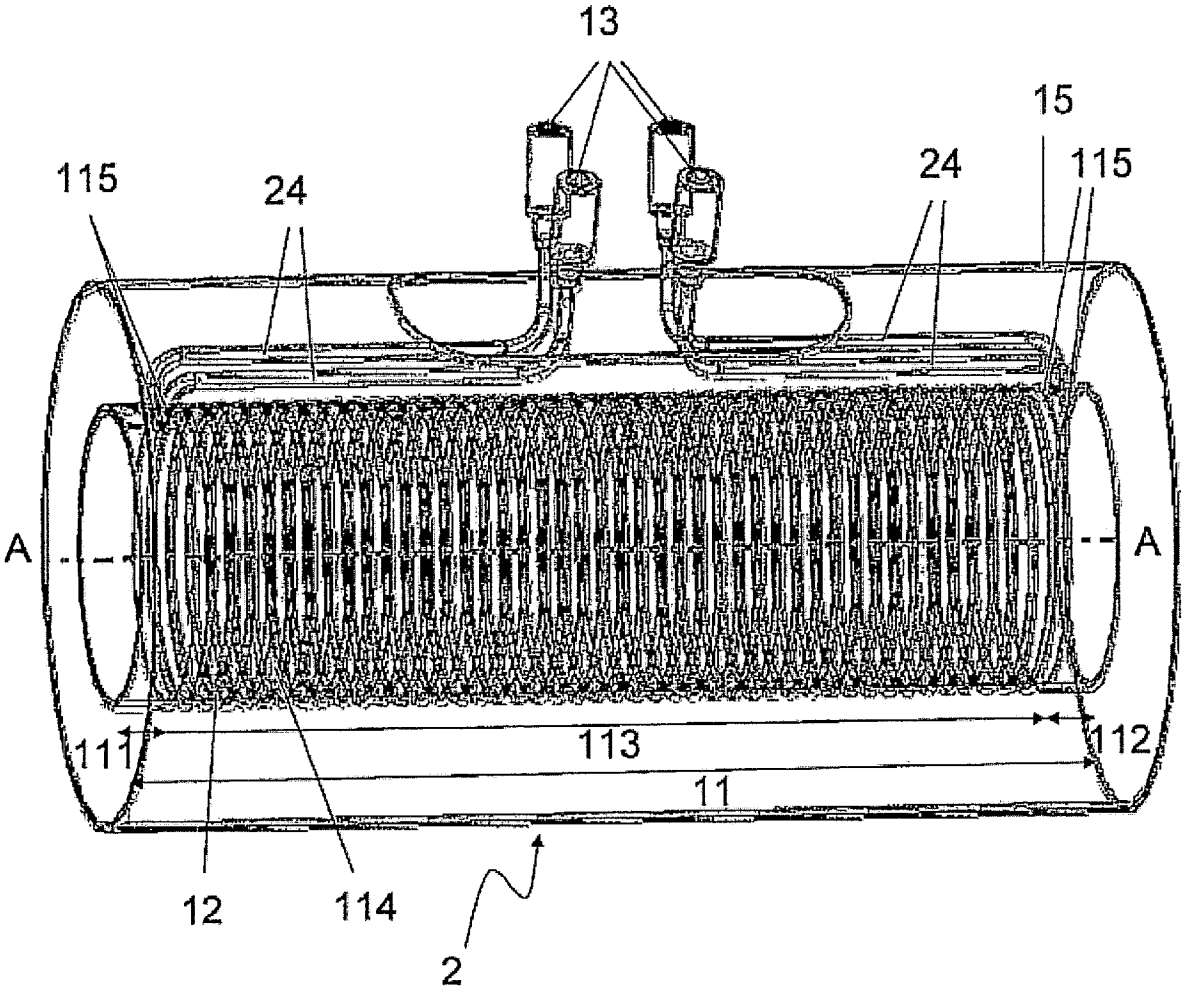
FIG. 2 is a depiction of a screen system with a tube-shaped screen according to a second embodiment form of the invention

FIG. 2 shows a screen system 2 with a tube-shaped screen 10 that in the depicted embodiment form has the form of a hollow cylinder. The tube-shaped screen 10 consists of a tube 11 that has two annular end sections 111, 112, between which a cylindrical section 113 is situated. In cylindrical section 113 lies a multiplicity of bright-colored sections 114, in which tube 11 has numerous small screen openings, which due to their small size are not individually plotted for reasons of clarity. In addition, tube 11 in cylindrical section 113 has a multiplicity of reinforcement ribs 12, which are dark-colored, to distinguish them from the sections with screen openings.

Additionally, one perceives four ultrasonic converters 13 and four feed-line sound conductors 24, which are a part of screen system 2. In this embodiment form, the use of four feed-line sound conductors 24 and four ultrasonic converters 13 especially serves to increase the vibrational energy transferred to tube 11. The screen system has a central axis A-A. The tube-shaped screen is surrounded by a housing 15, through which the feed-line sound conductors 14 are guided. The ultrasonic converters 13 are placed outside the housing and thus outside the section in which contact with the screened material would be possible.

The tube 11 is mechanically connected via the feed-line sound conductors 14 with the ultrasonic converters 13. In FIG. 2, the feed-line sound conductors 24 are designed with two curved sections. As was already explained using FIG. 1, through the ultrasonic converters 13, an ultrasonic oscillation is directed into the feed-line sound conductors 24 with an oscillation amplitude that is directed parallel to central axis A-A. The result of the curvature of the feed-line sound conductors 24 is that the oscillation amplitude obtains an additional component perpendicular to central axis A-A. The exact division of the components is determined by the geometric configuration of the feed-line sound conductors 24, especially by their curvature. In the embodiment example of FIG. 2, therefore, there is a division of the components of the amplitude of ultrasonic excitation that is different from the embodiment example of FIG. 1, since the geometric configuration of the feed-line sound conductors 24 is other than that of feed-line sound conductors 14 in FIG. 1. Along with curvature angles, the curvature radii and the cross sections of the feed-line sound conductors 14 and 24 play a decisive role for the attained size distribution of the two components of the amplitude of the ultrasonic excitation.

At contact points 115, the ultrasonic oscillation is transferred to tube 11. The vibration evoked thereby of tube 11 propagates out over tube 11. Through the longitudinal component of the amplitude of ultrasonic excitation, especially a propagation of ultrasound is promoted over the entire length of the tube-shaped screen, while the transverse component especially increases the efficiency of the screening process.

Figure 3:
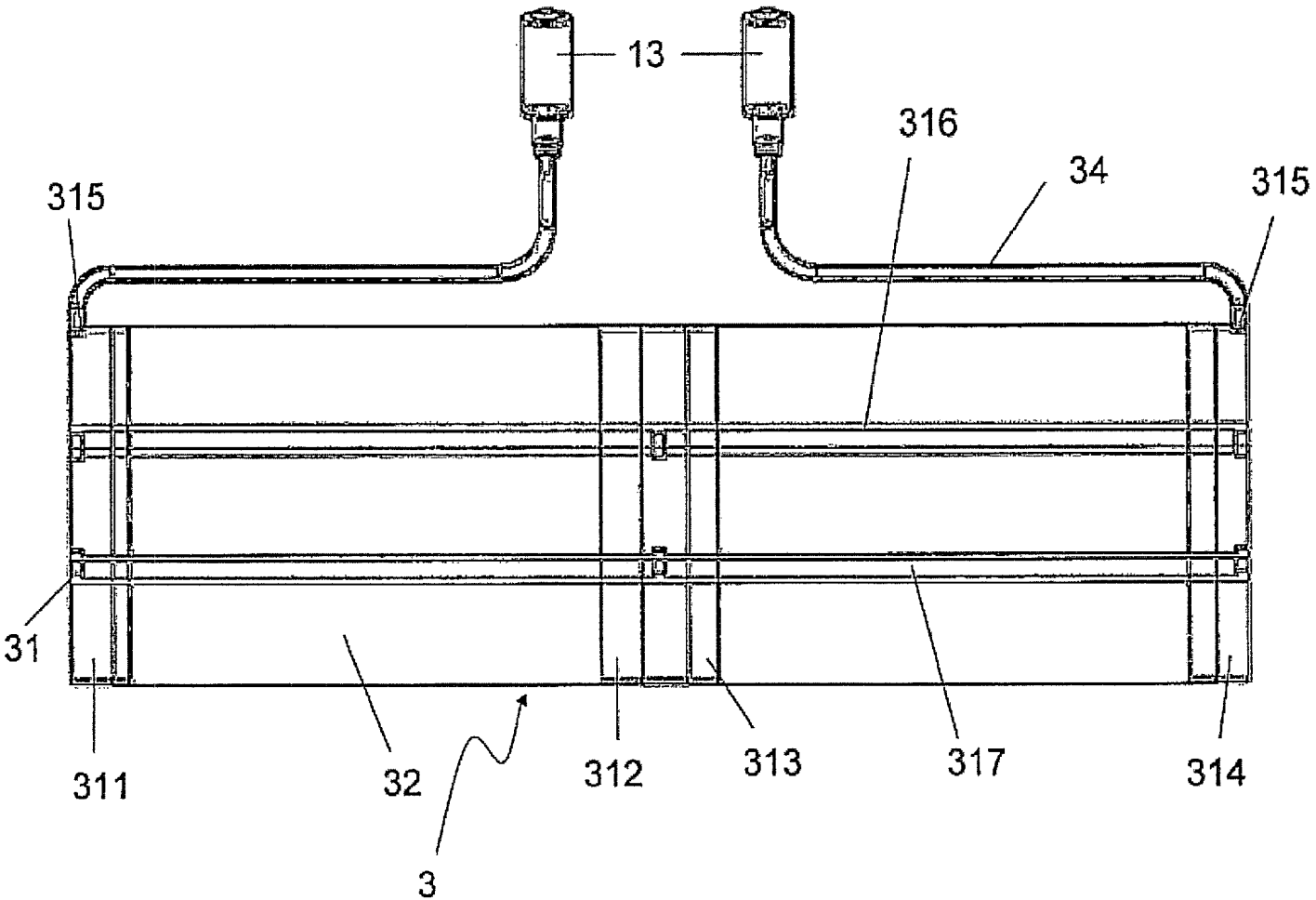
FIG. 3 is a depiction of a screen system with a tube-shaped screen according to a third embodiment form of the invention

Turning to FIG. 3, there is shown a screen system 3 with a tube-shaped screen 30. Screen 30 consists of a screen mesh 32 and a screen frame 31. The screen frame consists of four annular sections 311, 312, 313, 314 which define the cross section of a tube or hollow cylinder, which are connected with each other via two connection strips 316, 317, likewise parts of the frame, through which the length of the tube is prescribed. Owing to the components of the screen frame, in this way the length and cross section of the tube are preset. The screen mesh 32 is placed in tension on the screen frame in such a way that screen mesh 32 forms at least a part of the surface of tube-shaped screen 30. In particular, screen mesh 32 is not arrayed only in one plane. It would also be possible to use fewer or more annular sections 311, 312, 313, 314 and/or fewer or more connection strips 316, 317, as long as at least two annular sections 311, 312, 313, 314 and at least one connecting strip 316, 317 are present.

Additionally, FIG. 3 shows two ultrasonic converters 13 and two feed-line sound conductors 34, each of which has two curved sections. The feed-line sound conductors are connected at contact points 315 with the screen frame 31. In operating screen system 3, via the ultrasonic converters 13, an ultrasonic oscillation is fed into feed-line sound conductors 34 with an oscillation amplitude that is directed parallel to central axis A-A of tube-shaped screen 30. The result of the curvature of the feed-line sound conductors 34 is that the oscillation amplitude obtains an additional component perpendicular to central axis A-A. At contact points 315, the ultrasonic oscillation is transmitted to screen frame 31. The vibration of the screen frame 31 evoked thereby at the contact points 315 propagates outward over the entire screen frame 31 and at the same time leads to an ultrasonic excitation of screen mesh 32. The longitudinal component of the amplitude of ultrasonic excitation especially promotes ultrasonic propagation over the entire length of tube-shaped screen 30, while the transverse component especially increases the efficiency of the screening process and throughput through the screen meshes 32.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed:

1. A screen system with a tube-shaped screen, said screen system further comprising:

(a) a tube having at least one section with a plurality of screen openings, which are placed directly in the wall of said tube, and that forms a screen frame which defines at least the length and the cross section of said tube, and a screen mesh, that is tensioned on said screen frame, so that said screen frame forms at least a part of the wall of said tube-shaped screen;

(b) at least one ultrasonic converter; and (c) at least one feed-line sound conductor placed between said at least one ultrasonic converter and said tube, with said tube being configured as to be able by means of said ultrasonic converter and said at least one feed-line sound conductor to be subjected to ultrasonic excitation so that the amplitude of the ultrasonic excitation transferred to said tube has a component in a direction perpendicular to a central axis of said tube-shaped screen and a component in a direction parallel to said central axis of said tube-shaped screen.

2. The screen system according to claim 1, wherein with ultrasonic excitation the amplitude of the ultrasonic excitation at a contact point to said tube or to said screen frame has a component in a direction perpendicular to the central axis of said tube-shaped screen and a component in a direction parallel to the central axis of said tube-shaped screen.

3. The screen system according to claim 2, wherein said at least one feed-line sound conductor has at least one curved section.

4. The screen system according to claim 3, wherein said curved section has a curvature angle that is greater than 0 degrees (0°) and that is at maximum 90 degrees (90°).

5. The screen system according to claim 4, wherein said curvature angle is 90°.

6. The screen system according to claim 1, wherein said at least one feed-line sound conductor has a diameter of 12 millimeters (mm).

7. The screen system according to claim 1, wherein said at least one feed-line sound conductor is screwed or welded onto the surface of the pipe or of the screen frame.

8. The screen system according to claim 1, wherein said at least one ultrasonic converter is screw-connected with said at least one feed-line sound conductor.

9. The screen system according to claim 1, wherein a plurality of ultrasonic converters and a plurality of feed-line sound conductors are present.

10. The screen system according to claim 1, wherein a plurality of feed-line sound conductors is present and said tube or the screen frame is excitable via said plurality of feed-line sound conductors with ultrasound, with the direction of the amplitude of ultrasonic excitation being varied through differing ones of said feed-line sound conductors.

11. The screen system according to claim 1, wherein said screen system further comprises a housing which prevents screened materials from leaking into the environment, and that each of said ultrasonic converters are placed outside said housing.

12. A centrifugal screening machine, said centrifugal screening machine further comprising a screen system with a tube-shaped screen, said screen system further comprising:

(a) a tube having at least one section with a plurality of screen openings, which are placed directly in the wall of said tube, and that forms a screen frame which defines at least the length and the cross section of said tube, and a screen mesh, that is tensioned on said screen frame, so that said screen frame forms at least a part of the wall of said tube-shaped screen;

(b) at least one ultrasonic converter; and (c) at least one feed-line sound conductor placed between said at least one ultrasonic converter and said tube, with the tube being configured as to be able by means of said ultrasonic converter and said at least one feed-line sound conductor to be subjected to ultrasonic excitation so that the amplitude of the ultrasonic excitation transferred to said tube has a component in a direction perpendicular to a central axis of said tube-shaped screen and a component in a direction parallel to said central axis of said tube-shaped screen.

13. The centrifugal screening machine of claim 12, further comprising:

(a) a plurality of feed-line sound conductors is present and said tube, or the screen frame, is excitable via said plurality of feed-line sound conductors with ultrasound, with the direction of the amplitude of ultrasonic excitation being varied through differing ones of said feed-line sound conductors; and (b) a housing which prevents screened materials from leaking into the environment, wherein each of said ultrasonic converters are placed outside said housing.

14. A method for operating a screen system, said method comprising the steps of:

(a) providing a tube-shaped screen which comprises a tube that has at least one section with screen openings, which are placed directly in the wall of said tube, (b) providing a means for screening material, said material screening means capable of being excited to oscillations by ultrasound; and (c) exciting said material screening means with an ultrasonic excitation whose amplitude has a component in a direction perpendicular to a central axis of said tube-shaped screen and a component in a direction parallel to said central axis of said tube-shaped screen.

15. The method of claim 14, wherein said means for screening is selected from the group consisting of:

(a) a screen frame; and (b) a screen mesh.

16. The method of claim 14, further comprising the step of generating by a feed-line conductor said amplitude that has a component in a direction perpendicular to a central axis of said tube-shaped screen and a component in a direction parallel to said central axis of said tube-shaped screen.

17. The method of claim 14, further comprising the step of generating by a plurality of feed-line conductors said amplitude that has a component in a direction perpendicular to a central axis of said tube-shaped screen and a component in a direction parallel to the central axis of said tube-shaped screen.

18. The method of claim 14, wherein the frequency of said ultrasonic excitation is varied.

19. The method of claim 18, wherein said frequency of said ultrasonic excitation is continuously varied in a range between 32 kiloHertz (kHz) and 38 kiloHertz (kHz).

20. A method for operating a centrifugal screening machine, said method comprising the steps of:

(a) providing a tube-shaped screen which comprises a tube that has at least one section with screen openings, which are placed directly in the wall of said tube, (b) providing a means for screening, said screening means capable of being excited to oscillations by ultrasound; and (c) exciting said screening means with an ultrasonic excitation whose amplitude has a component in a direction perpendicular to a central axis of said tube-shaped screen and a component in a direction parallel to said central axis of said tube-shaped screen.

* * * * *